United States Patent [19]

Hoelzel, Jr.

[11] 4,230,729

[45] Oct. 28, 1980

[54] ONE PIECE, COLLAPSIBLE PACKAGE

[76] Inventor: Fred L. Hoelzel, Jr., 21 Greenmam Ave., Westerly, R.I. 02891

[21] Appl. No.: 21,101

[22] Filed: Mar. 16, 1979

[51] Int. Cl.[2] ..... B65D 85/00; B65D 5/10; B65D 5/50; B65D 5/56

[52] U.S. Cl. ..... 426/124; 206/45.14; 206/45.31; 220/403; 229/22; 229/37 R; 229/38; 229/39 R; 229/41 B; 426/129; 426/393; 426/411; 229/41 D

[58] Field of Search ..... 426/124, 129, 393, 410, 426/412, 113, 106, 643, 411; 206/45.31, 45.14; 220/403; 229/22, 37 R, 38, 39 R, 41 B, 41 D

[56] References Cited

U.S. PATENT DOCUMENTS

| | | | |
|---|---|---|---|
| Re. 29,185 | 4/1977 | Tolaas | 229/22 |
| 707,073 | 8/1902 | Beers | 206/45.31 |
| 1,526,397 | 2/1925 | Thornton | 220/23.2 |
| 1,906,375 | 5/1933 | Grande | 426/129 |
| 1,987,491 | 1/1935 | Nejelski | 206/45.31 |
| 2,104,999 | 1/1938 | Markowitz | 206/45.31 |
| 2,220,110 | 11/1940 | Layton | 229/22 |
| 2,727,620 | 12/1955 | Buttery | 206/45.31 |
| 2,736,427 | 2/1956 | Trombetta | 206/45.31 |
| 2,822,917 | 2/1958 | Tuensmeier | 206/45.31 |
| 2,844,475 | 7/1958 | Barnes et al. | 426/113 |
| 2,946,433 | 7/1960 | Hennessey | 206/45.31 |
| 2,951,765 | 9/1960 | Robson | 426/113 |
| 3,012,894 | 12/1961 | Nagel | 426/113 |
| 3,118,533 | 1/1964 | Curtis | 426/106 |
| 3,222,190 | 12/1965 | Davis | 426/120 |
| 3,235,390 | 2/1966 | Vischer | 426/113 |
| 3,409,445 | 11/1968 | Hall | 426/121 |
| 3,410,697 | 11/1968 | Stephenson | 426/114 |
| 3,651,928 | 3/1972 | Weisman | 206/45.31 |
| 3,659,704 | 5/1972 | Collura et al. | 206/45.31 |
| 3,684,085 | 8/1972 | Desmond | 206/45.31 |
| 3,692,545 | 9/1972 | Moore | 426/393 |
| 3,730,335 | 5/1973 | Tarrson | 206/45.31 |
| 3,876,131 | 4/1975 | Tolaas | 426/113 |
| 3,929,222 | 12/1975 | Smith et al. | 206/45.31 |
| 3,942,710 | 3/1976 | Collie | 206/45.31 |
| 4,037,717 | 7/1977 | Roccaforte | 206/45.31 |
| 4,097,611 | 6/1978 | Seiferth | 426/121 |
| 4,106,615 | 8/1978 | Hiroshi | 206/45.31 |
| 4,117,924 | 10/1978 | Growney | 206/45.31 |

*Primary Examiner*—Steven L. Weinstein
*Attorney, Agent, or Firm*—Bacon & Thomas

[57] ABSTRACT

A one piece, collapsible package especially adapted for packaging pre-cooked, frozen lobster, hermetically sealed in a clear plastic bag is disclosed. The package includes means for attractively displaying the lobster in the package and means for securely holding it in the package.

5 Claims, 7 Drawing Figures

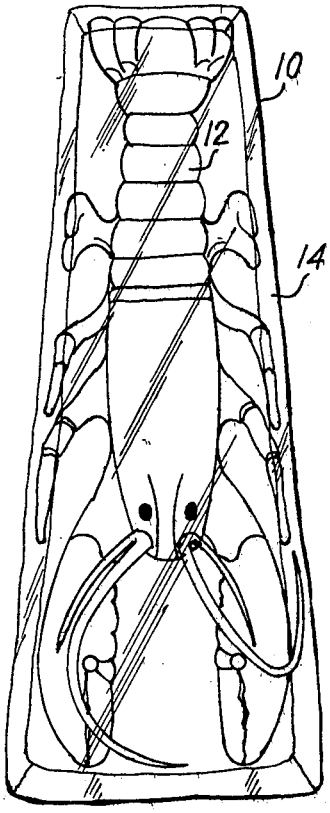
Fig. 1
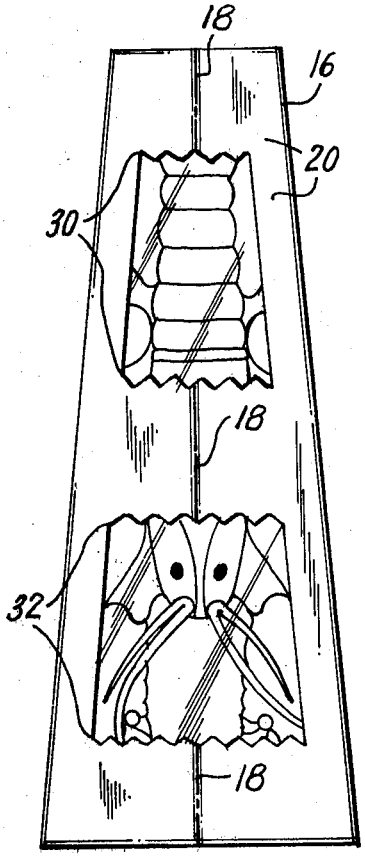
Fig. 2
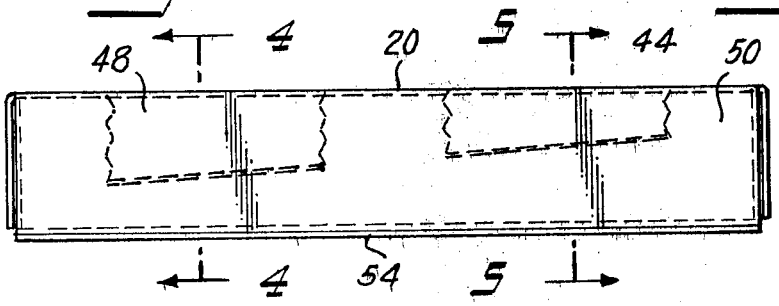
Fig. 3
Fig. 4
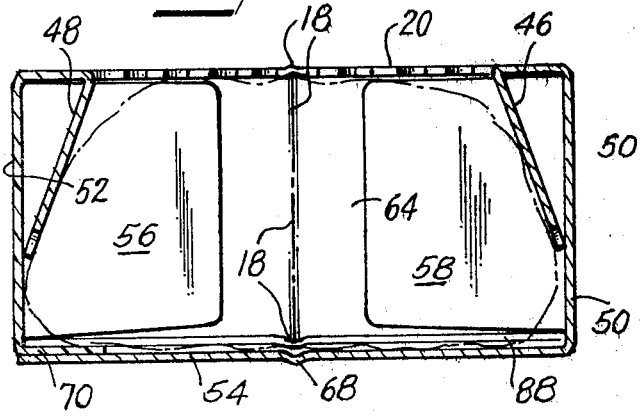
Fig. 5
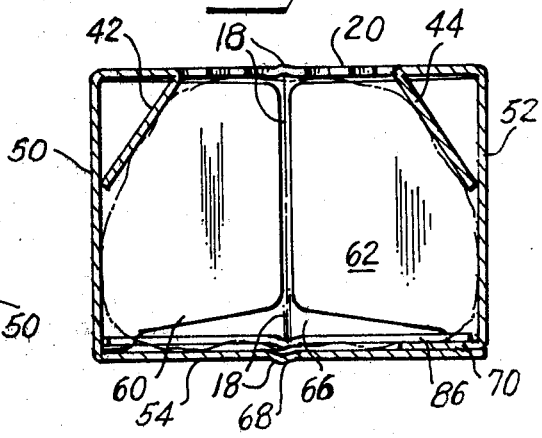

ONE PIECE, COLLAPSIBLE PACKAGE

BACKGROUND OF THE INVENTION

1. Field of the Invention

The present invention is directed to a one piece, collapsible box adapted for packaging foodstuffs. The box is especially suited for packaging pre-cooked, frozen lobster which has been hermetically sealed in a plastic cooking pouch.

2. Description of the Prior Art

During the past several years processes for pre-cooking, freezing and hermetically sealing foodstuffs in a boilable cooking pouch have become very popular. Such processes facilitate widescale distribution of food products by increasing the self-life of the frozen products and provide a product which is simply prepared for consumption by immersion in boiling water. In application to seafoods, the "boil-in-bag" further eliminates odors associated with various fish and shellfish.

In particular, the "boil-in-bag" has been found to be an effective means of distributing lobster. Each lobster is fully cooked, vacuum-packed and hermetically sealed in a strong, thick, boilable plastic bag that prevents freezer burn. The convenience to the retail customer and restaurant resides in the ability to store the lobster for extended periods of time and to prepare it with relatively little time and effort.

While the "boil-in-bag" facilitates handling by the consumer, there is a need for a package which attractively displays the lobster in retail markets. In addition to effectively displaying the lobster, the lobster package must be designed so as to be readily transported in large quantities.

SUMMARY OF THE INVENTION

Accordingly, it is a primary object of the present invention to provide a unique package for individual, pre-cooked, frozen lobster encased in a hermetically sealed boilable bag, which combines attractiveness with functionality.

Still other objects and advantages of the invention will be apparent to those of skill in the art upon review of the entire disclosure contained herein.

These objects and advantages are provided by a one piece, collapsible package comprising generally trapezoidal shaped top and bottom panels each having a longitudinal crease disposed in such a manner as to allow the panels to be collapsed lengthwise, first and second generally rectangular side panels hingedly connected to one of said side panels and adhesively connected to said bottom panel. The top panel and two side panels have end flaps which, when hingedly engaged form the front and rear sections of the package. The top panel further contains flaps which open inwardly to form windows for displaying the contents of the package. The inwardly folded window flaps also serve to provide lateral support for the object contained in the package. The package is typically made from a rigid paper material, such as cardboard.

BRIEF DESCRIPTION OF THE DRAWINGS

FIG. 1 is a plan view of a vacuum packaged lobster prior to its insertion into a display and storage container;

FIG. 2 is a plan view of the collapsible container of the present invention with the package of FIG. 1 inserted therein;

FIG. 3 is a side elevation view of the container of FIG. 2, the vacuum package being omitted for purposes of illustration;

FIG. 4 is an enlarged transverse sectional view, through the container of FIG. 3, the outline of the vacuum package being shown in phantom lines, taken on the line 4—4 of FIG. 3;

FIG. 5 is an enlarged transverse sectional view, similar to FIG. 4, taken on the line 5—5 of FIG. 4;

DETAILED DESCRIPTION OF THE INVENTION

Figure 6:
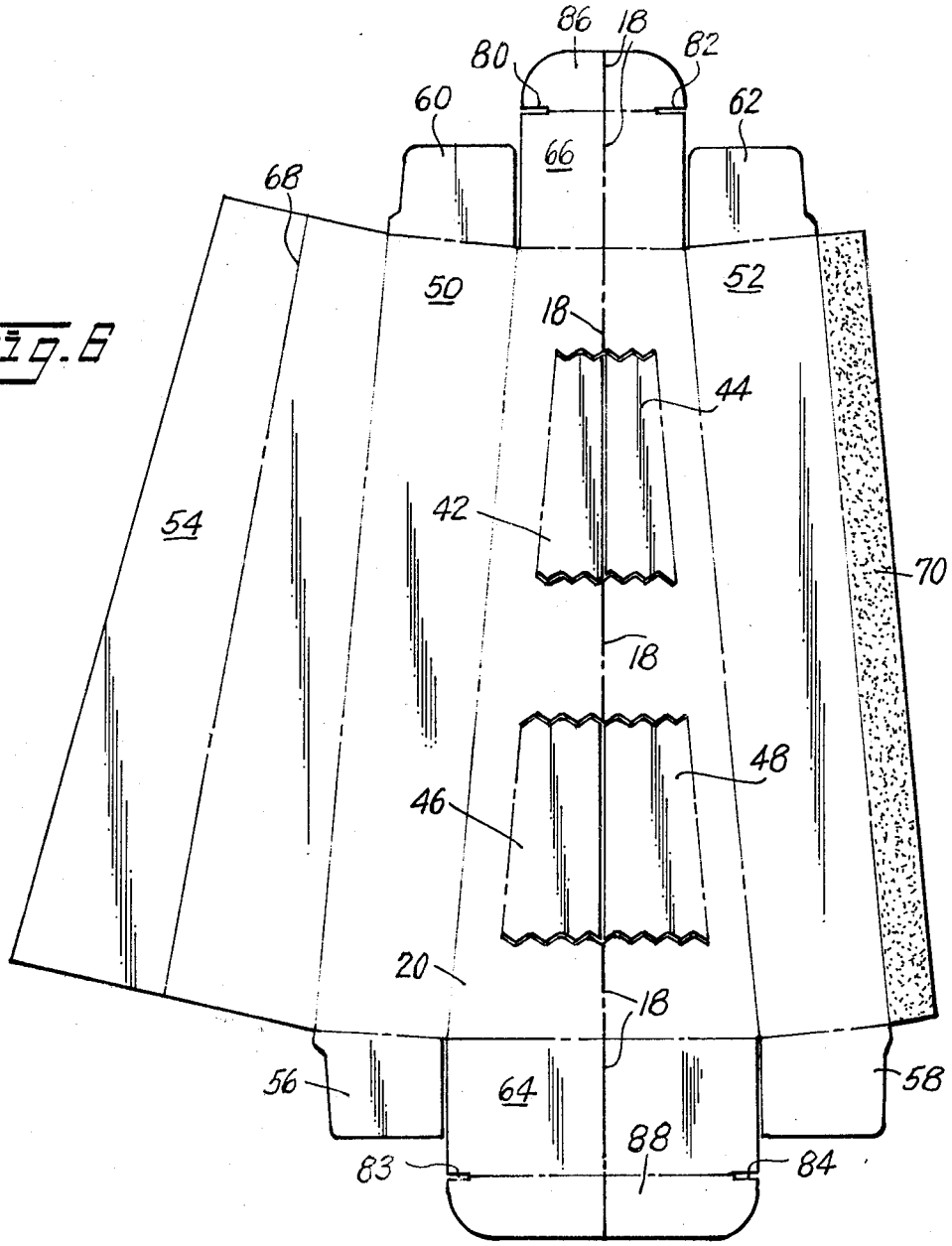
FIG. 6 is a plan view of the pattern blank for forming the container.

Referring to the figures of drawing, FIG. 1 shows the product 10 which the package of the invention is designed to accommodate. The product comprises a pre-cooked, frozen lobster 12, which has been hermetically sealed in a thick, boilable clear plastic bag 14.

FIGS. 2–5 picture the assembled package of the invention 16, containing product 10. Longitudinal crease 18 runs the length of the generally trapezoidal shaped top panel 20. Top panel 20 is hingedly connected to generally rectangular shaped side panels 50 and 52.

Windows 30 and 32 are formed by folding window flaps 42, 44, 46 and 48 inwardly. The window flaps serve the dual function of opening to form windows for attractively displaying the product and providing lateral support for the product inside the package. Thus, when the product is inserted into the package it pushes the folded-down flaps outward until their edges contact the side panels (see FIGS. 4 and 5). This, in effect, forms a fairly rigid inner wall which holds the product in place within the package and insures that it is centered in the display windows. The window flaps may be given a scallop shaped design to embellish the package.

Side panels 50 and 52 are hingedly connected to top panel 20 and to the generally trapezoidal shaped bottom panel 54. The side panels have hingedly connected end flaps 56, 58, 60 and 62 which, preferably, are given a tapered design to facilitate assembly of the package. The top panel 20 also has two end flaps 64 and 66 which are preferably given rounded corners to facilitate insertion thereof between the inside surface of the bottom panel 54 and the tapered edges of the end flaps on the side panels 56, 58, 60 and 62 which are folded perpendicular to the side panels when the package is assembled. Longitudinal crease 18 extends over the length of the end flaps of the top panel. Bottom panel 54 also has a longitudinal crease 68 running parallel to the crease 18 in the top panel. These creases allow the package to be collapsed as shown in FIG. 7 and further allows the package to more readily conform to the peculiar shape of the product being packaged.

The package is connected along its circumference by means of generally rectangular shaped panel 70, which is hingedly connected to side panel 52 and adhesively connected to bottom panel 54.

FIG. 6 pictures the unassembled package prior to adhesively connecting panel 70 to bottom panel 54. This figure further shows the various seams which hingedly connect the panels and flaps. The preferred design of end flaps 64 and 66 is also shown. In addition to rounded corners, these flaps may be given notches 80, 82, 83 and 84 along the final seam to facilitate insertion of tabs 86 and 88 between the inside surface of the bottom panel and the tapered edges of the folded end flaps of the side panels.

Figure 7:
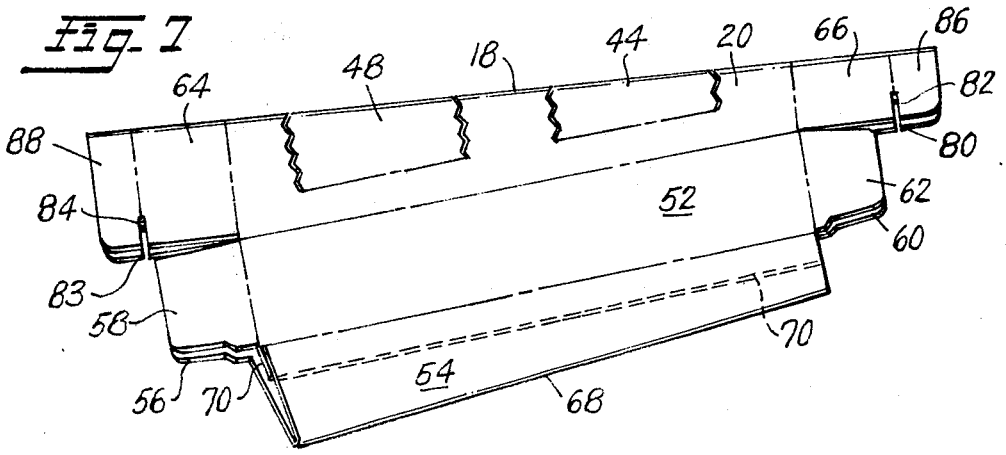
FIG. 7 is a perspective view, on a smaller scale, of the collapsible container showing its folded condition prior to its use.

As previously described, the longitudinal crease extending along the length of the top panel and its end flaps and the bottom panel, allow the package to be collapsed along the creases in the manner shown in FIG. 7. This greatly reduces handling difficulties when the unassembled packages are transported.

When assembled, the package of the invention is especially adapted for the tapered shape of lobsters. When packing the packaged lobsters in a case, the trapezoidal shape allows for compact packing by placing the wide top section of one package next to the narrower bottom section of the adjacent package.

While the present invention has now been described in terms of certain preferred embodiments, the skilled artisan will readily appreciate that various modifications, changes, omissions and substitutions may be made without departing from the spirit thereof. It is intended, therefore, that the present invention be limited solely by the scope of the following claims.

What is claimed is:

1. A one piece package containing contents comprising a pre-cooked, frozen lobster hermetically sealed in a boilable plastic bag, said package comprising:

(a) a generally trapezoidal shaped bottom panel having a central longitudinal crease running the length thereof, (b) a first generally rectangular shaped side panel hingedly connected to said bottom panel having hingedly connected end flaps, (c) a generally trapezoidal shaped top panel corresponding in shape and size substantially to said bottom panel and hingedly connected to said first side panel, having a central longitudinal crease running the length thereof and having hingedly connected end flaps and a plurality of hingedly connected window flaps which open inwardly to form one or more windows, (d) a second generally rectangular shaped side panel corresponding in shape and size substantially to said first side panel and hingedly connected to said top panel, having hingedly connected end flaps, and (e) a generally rectangular shaped panel hingedly connected to said second side panel and adhesively connected to said bottom panel;

said inwardly openinc window flaps being pushed by the contents of the package such that their edges contact the side panels, thereby defining fairly rigid inner walls which hold the contents of the package, provide lateral support for the contents in the package and ensure that the contents are centered in the package, and said longitudinal creases on said top and bottom panels being parallel to each other thereby allowing the package to be collapsible when the contents of the package are removed and the end flaps are not engaged and further allowing the package to more readily conform to the shape of the contents.

2. The package as defined by claim 1, wherein said top panel contains four hingedly connected window flaps which open inwardly to form two windows for displaying the contents of said package.

3. The package as defined by claim 2, wherein said windows are separated by a portion of said top panel.

4. The package as defined by claim 1, wherein said end flaps of said side panels have a tapered edge to accommodate insertion of the end flaps of said top panel adjacent to the inside surface of said bottom panel when the flaps are hingedly engaged.

5. The package as defined by claim 4, wherein said end flaps of said top panel have rounded corners to facilitate insertion thereof between the inside surface of said bottom panel and the tapered edges of the end flaps of said panels which are folded perpendicular to said side panels.

* * * * *